United States Patent [19]

Yang

[11] Patent Number: 4,969,638

[45] Date of Patent: Nov. 13, 1990

[54] IMPROVEMENT ON SLIDING CLAW AND COUPLING STRUCTURE

[76] Inventor: Tai-Her Yang, 5-1 Taipin St., Si-Hu Town, Dzan-Hwa, Taiwan

[21] Appl. No.: 218,208

[22] Filed: Jul. 13, 1988

[51] Int. Cl.[5] ..... B25B 1/24

[52] U.S. Cl. ..... 269/261; 269/258; 269/265

[58] Field of Search ..... 269/258–262, 269/268, 271, 265

[56] References Cited

U.S. PATENT DOCUMENTS

| | | | |
|---|---|---|---|
| 4,632,375 | 12/1986 | Yang | 269/258 |
| 4,717,132 | 1/1988 | Yang | 269/261 |
| 4,732,373 | 3/1988 | Yang | 269/265 |
| 4,767,110 | 8/1988 | Yang | 269/261 |

*Primary Examiner*—J. J. Hartman

*Attorney, Agent, or Firm*—Leonard Bloom

[57] ABSTRACT

A clamping apparatus having a pair of vise jaws. A pair of concave recesses are formed laterally of each other in the face of the vise jaw. Each concave recess has a base with an arcuate groove therein. A semi-circular clamping member is disposed in each concave recess. The clamping member has a convex surface complementary to the concave recess. The clamping member further has an arcuate rib thereabout which is complementary to the arcuate groove in the clamping member. The upper surface of the clamping member has a semi-circular boss thereon which forms a step-like relationship to the upper surface. A pair of retaining covers are disposed on the upper surface of the jaw and extend over the clamping member so as to abut the semi-circular boss. The retaining cover secures the clamping member to the jaw and also prevents processing chips from falling between the concave recess in the jaw and the convex surface of the clamping member. The clamping members are pivotally mounted in the concave recess and may swivel therein. In an alternate embodiment, the upper .surface of the clamping member is dovetailed downwardly, sloping from the convex surface to the base of the semi-circular boss. The retaining cover has a protruding sloping lip such that when the retaining cover is disposed on the upper surface of the vise jaw, the sloping lip is complementary to the sloping surface of the clamping member.

3 Claims, 3 Drawing Sheets

IMPROVEMENT ON SLIDING CLAW AND COUPLING STRUCTURE

FIELD OF THE INVENTION

The present invention relates to a clamping apparatus having independently movable clamping members.

BACKGROUND OF THE INVENTION

There have been numerous clamping devices which describe means of holding a workpiece. The following U.S. patents have been issued to the applicant.

| U.S. Pat. No. | ISSUE DATE |
|---|---|
| 4,632,375 | 12/30/86 |
| 4,648,555 | 03/10/87 |
| 4,717,132 | 01/05/88 |
| 4,732,373 | 03/22/88 |
| 4,763,887 | 08/16/88 |
| 4,767,110 | 08/30/88 |
| 4,807,863 | 02/28/89. |

The previous U.S. patent application Ser. No. 743,981 (U.S. Pat. No. 4,732,373, after being put into practice for quantity production, was found to have defects existing between its rotary and sliding clamping members and the socket base of the jaw. These included the connection of the pin in the socket base and the rotary and sliding clamping member. The connection between them is poor and it is difficult to control the quality. This has affected the rotating action and has resulted in the production process being complex. In order to solve the said defects effectively, the applicant has made the following improvements.

SUMMARY OF THE INVENTION

A rib (or outer flange) is installed below the rotary and sliding clamping member and an arcuate groove is provided on the bottom of socket base.

The rib or outer flange below the rotary and sliding clamping member may further have coaxial groove on its internal side. Both ends of the groove are closed in order to form a limit for turning the clamping members with the pin on the bottom side of jaw socket (recess) base.

The upper side of rotary and sliding clamping member has a retaining (or chip-proof) cover which is attached to the surface of the jaw and clamping member in order to prevent processing chips from being falling into the portion between the rotary clamping member and the socket base. The retaining cover also secures the clamping member in the socket.

The aforesaid retaining cover may be installed over each individual clamp member or may be, in an alternate embodiment, disposed over all the clamping members. It does not interfere with the clamping ability provided by rotary clamping member. The aforesaid clamping member can clamp medium, large and thin workpieces. Alternately, the upper surface of the rotary and sliding clamping member also can be made into a step-like relationship to couple with the retaining cover.

The present invention may be applied to the jaw of various types of clamping devices such as:

(1) The upper surface of the jaw has a longitudinal groove extending the width of two clamping members in which there is fastened a flat top retaining cover. The cover further has auxiliary clamping faces on both sides of the jaw.

(2) The upper surface of the jaw is flat and a flat retaining cover is attached thereto. Auxiliary inverted L-shaped clamping faces are mounted at both sides of the jaw.

(3) The upper surface of the jaw is flat for attaching a single piece retaining cover over the jaw and the clamping members.

(4) The upper surface of the semi-circular clamping member has a boss thereon forming a step-like relation to the clamping member. The bottom of the clamping member has an arcuate rib thereabout. The rib is engaged in an arcuate groove in the base of a concave recess in the jaw. The upper surface of the jaw has a shoulder thereon about the concave recess. A retaining cover shaped as an arcuate plate is disposed in the shoulder in the jaw and extends over the clamping member to abut the boss on the clamping member. A retaining cover may be provided for each individual clamping member.

(5) The upper surface of the clamping member is dovetailed downwardly, sloping from the convex surface of the clamping member to the base of the semi-circular boss. The retaining cover has a lower surface with a protruding sloping lip. When the retaining cover is disposed in the arcuate shoulder, the sloping lip is complementary to the sloping surface of the clamping member.

The coupling between the semi-circular clamping member having a convex surface and the concave recess in the jaw further may comprise an arcuate groove in the base of the concave recess and a complementary arcuate ridge on the base of the clamping member. The concave recess and the convex surface are formed about a vertical axis, wherein in a cross-sectional plane substantially at right angles to the respective axis, each axis forms the center of a semi-circle substantially defining the respective concave recess and convex surface.

Further embodiments having an arcuate rib on the base of the clamping member and a complementary arcuate groove in the base of the recess in the jaw include:

(1) The convex surface of the clamping member has a blind-ended groove therein and a penetrating hole communicating with said groove. Also, there is a tapping hole in the concave recess which communicates with the blind end groove. A connecting pin is inserted through the penetrating hole into the tapping hole. The pin extends into the blind end groove and permits the clamping member to rotate without interference.

(2) The penetrating hole may have a flared shape on the clamping side of the clamping member.

These and other objects of the present invention will become apparent from a reading of the following specification, taken in conjunction with the enclosed drawings.

BRIEF DESCRIPTION OF THE DRAWINGS

FIG. 1—1 is a top view of FIG. 1.

FIG. 1-2 is a side-sectional view of FIG. 1.

FIG. 2 is an exploded perspective view showing a step-like relationship.

FIG. 2-1 is a sectional view of FIG. 2.

FIG. 3-1 is a cross-sectional view of FIG. 3.

DETAILED DESCRIPTION OF THE INVENTION

The present invention is an improvement of the clamping device of U.S. Pat. No. 4,732,373. The major improvements are the means of mounting the semi-circular clamping member in the base of the concave recess in the jaw which includes a rib on the clamping member and a complementary groove in the jaw. Another improvement is a guide hole in the base of the clamping member and a cooperating pin extending from the base jaw such that the clamping member may swivel about the pin and be secured to the jaw. A further improvement is a retaining cover on the top of the clamping member to prevent processing chips from falling between the concave recess in the jaw and the convex surface of the clamping member. The retaining cover may be a single molded piece which covers the appropriate portion of the top of the jaw. The retaining cover may also be individual segments which are disposed in an arcuate shoulder in the top of the jaw and extend over the top of the semi-circular clamping member to the base of a boss thereon. The retaining cover, in another embodiment has a protruding sloping lip which is complementary to a sloping surface of the top of the clamping member.

Figure 1:
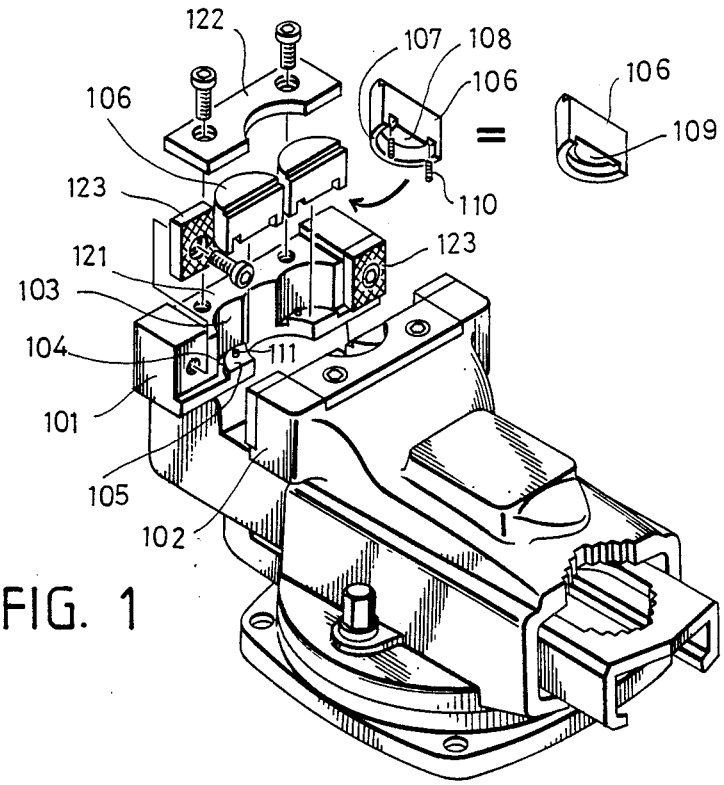
FIG. 1 is an exploded perspective view of the present invention, showing the upper side of jaw having a longitudinal groove on both sides of the clamping members for retaining a flat retaining cover, and also showing a clamping face on the both sides of its jaw for installing lateral auxiliary flat jaws.

(a) As shown in FIG. 1, the upper face of jaw has a longitudinal groove on both sides of the rotary/sliding clamping members to engage the retaining cover, the retaining cover has a lateral clamping face on the both sides of jaw. FIG. 1—1 is a top view of FIG. 1. FIG. 1-2 is a side-sectional view of FIG. 1.

Figure 1A:
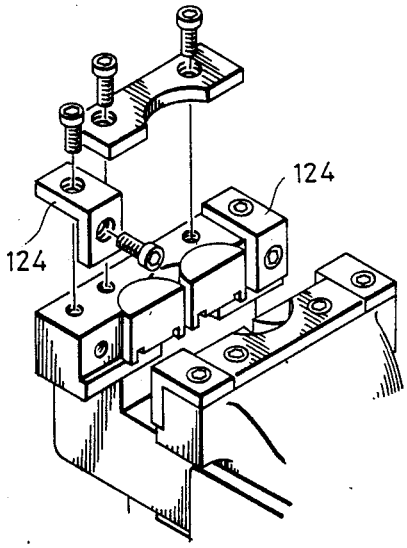
FIG. 1A is an exploded view showing the upper side of jaw is flat for locking the retaining cover, and a clamping face on both sides of its jaw is provided for installing inverted L-shaped lateral auxiliary flat jaws.

(b) As shown in FIG. 1A, the upper side of the jaw is flat to engage the retaining cover. There are also inverted "L" shaped auxiliary flat clamping members which are mounted on either side of the retaining cover.

Figure 1B:
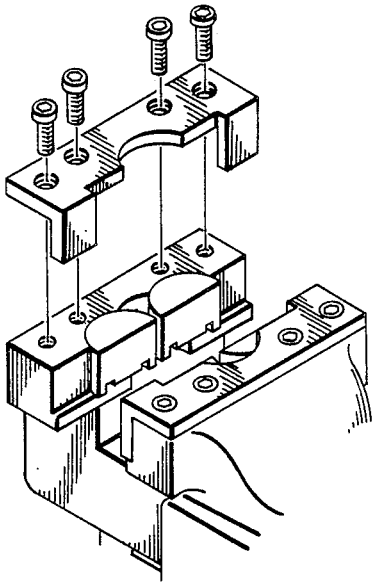
FIG. 1B is an exploded view showing the upper side of jaw is flat for locking a one-piece mold retaining cover and a flat jaw on both sides of jaw.
Figure 1:
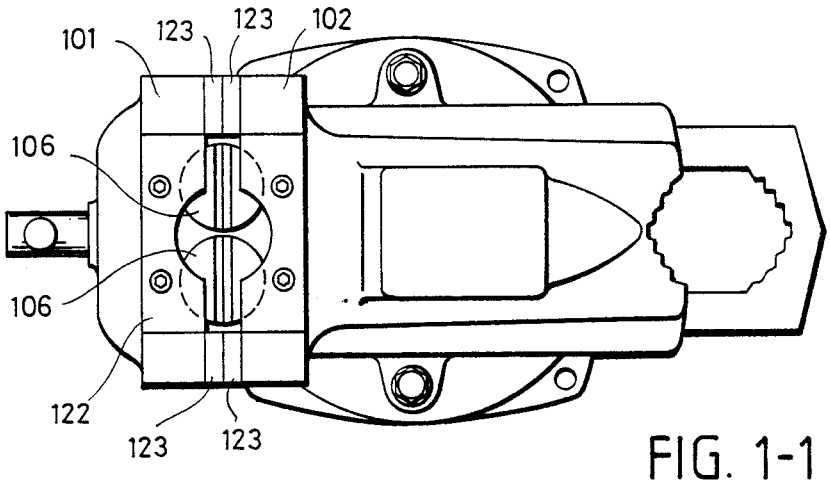
Figures 1, 2:
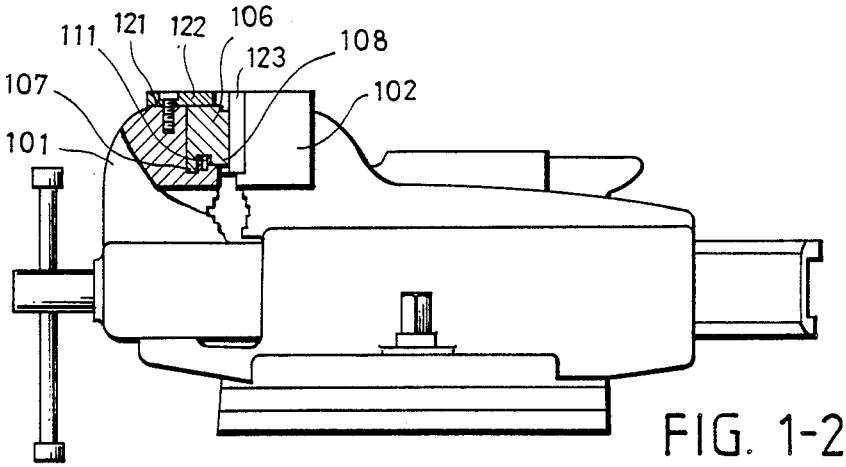

(c) As shown in FIG. 1B, the upper side of the jaw is flat to engage the retaining cover on the top of each jaw. The retaining cover also includes the auxiliary flat clamping members. Referring to practical examples from (a) to (c), it primarily comprises two counter-clamping jaw sets 101 and 102. Their structure are the same and the structure relating to one of the jaws and rotary/sliding clamping members is hereby explained as below which also describes the other jaw. In FIG. 1, the jaw openings are in line and have two sockets (or concave recesses) found laterally of each other in the jaw face. Each socket respectively has a concave vertical face 103. The bottom rim of the socket 105 has an arcuate groove 104. The clamp member 106 is semi-circular in cross-section having a planar or flat upper side and having a rib 107 thereabout. The arcuate rib 107 engages (couples) with the arcuate groove 104 of the aforesaid jaw socket base to rotate/slide smoothly therein. Its features lie in.

The equi-center of bottom side of rotary/sliding clamping member 106 with the aforesaid arcuate rib 107 has a complementary concave groove 108 with both ends closed (one-piece mold 109 or having a pin 110 inside). The clamping member 106 couples or engages with the vertical pin 111 inside the socket base 105 to limit the horizontal turning angle of the clamping member 106 and prevent it from falling.

The upper sides of jaws 101 and 102 have a longitudinal groove 121 extending the width of both sets of rotary/sliding clamping members 106 for locking the retaining cover 122. This limits the rotary sliding clamp members 106 from shifting up and down and also prevents the processing chips from entering between the clamp member 106 and the jaw. The intermediate part of the socket base of the jaw is concave to increase the ease of clamping a workpiece. Both sides of the jaw can be obliquely retracted backwards or maybe parallel and engages two parallel-clamping lateral flat jaws 123.

If the upper side of the aforesaid jaw is a plane instead of a longitudinal groove with intermediate concave portions, it is possible to select an inverted "L" shaped lateral jaw 124 to be locked on both sides of jaw, or a retaining cover extending toward both sides. The rim of the jaw and the flat jaw are respectively locked (as by threaded screws) on both sides of jaw. Besides, the lateral flat jaw and the retaining cover can also be made as a one-piece mold. The retaining cover additionally installed on the aforesaid jaw can also constitute a clamping function for the workpiece by its vertical face during clamping.

The retaining structure of the jaw and rotary/sliding clamp member can be further designed including being formed as a recessed structure. That is, as shown in FIG. 2B, the top side of rotary/sliding clamping member is dovetailed downwardly, sloping from the convex surface of the clamping member to the base of a semi-circular boss such that the boss has a step-like relationship to the clamping member.

FIG. 2 shows the top side 203 of the rotary/sliding clamping member 201 having a semi-circular boss 202 thereon, the boss having a base and an upper surface such that the boss has a step-like relationship to the clamping member. The clamping member 201 is disposed in the recess 204 in the jaw and the jaw further has an arcuate shoulder 207 formed at the top surface of the jaw 206. A retaining cover 205 formed as an arcuate plate is disposed in the arcuate shoulder 207 and has a flange which extends over the top side 203 of the rotary/sliding clamping member 201 so as to abut the semi-circular boss 202. A separate retaining cover 205 is disposed on each clamping member 201. Means, such as a threaded bolt are provided to secure the retaining cover to the vise jaw.

Figure 2:
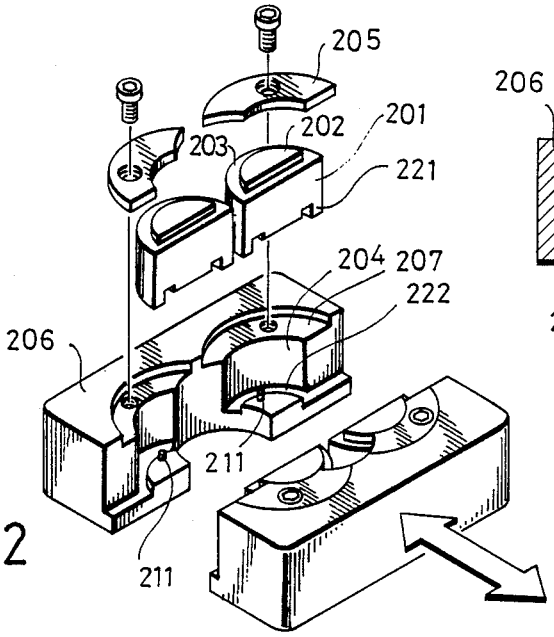
Figures 1, 2:
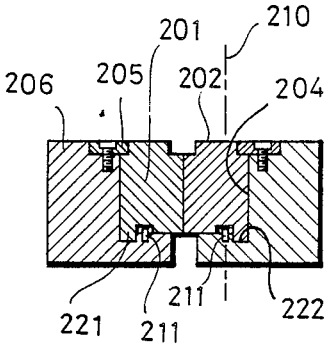
Figure 2A:
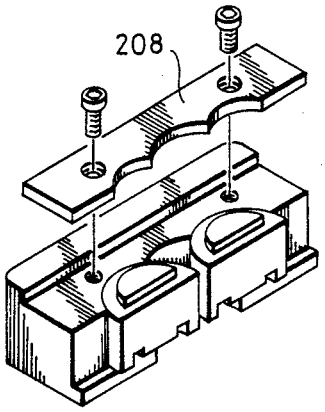
FIG. 2A is an exploded view of FIG. 2, showing a one-piece retaining cover which extends over two clamping members.

FIG. 2A shows a single molded piece retaining cover 208 which is an alternate embodiment of the present invention. This is similar to the embodiment shown in FIG. 1. Whether the retaining cover is one piece or is for each individual clamping element, the retaining cover does not interfere with the clamping ability of the clamping element.

Figure 2B:
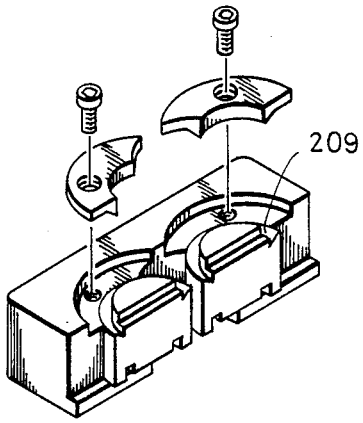
FIG. 2B is an exploded view showing the clamping member which is dovetailed downwardly, complementary with the lip on the retaining cover.

In still another embodiment, as shown in FIG. 2B, the upper surface 209 of each clamping member 201 is dovetailed downwardly, sloping from the convex surface of the clamping member 201 to the base of the semi-circular boss 202 such that the boss 202 has a step-like relationship to the clamping member 201. Each retaining cover 205 further has a lower surface having a protruding sloping lip 209 thereabout. When the retaining cover 205 is disposed in the arcuate shoulder 207, the sloping lip 209 is complementary to the sloping surface of the clamping member 201.

FIG. 2–1 is a cross-sectional view of the above described disposition of the clamping member 201 in the recess 204 showing the retaining cover 205 abutting the boss 202 and disposed on the top of the jaw 206. Thus the retaining cover 205 serves to keep out processing chips and also secures the clamping member 201 in the jaw. FIG. 2–1 further shows the two jaws of the clamping device butted together and illustrates that the disposition of the above identified components is the same for each jaw. In addition, FIG. 2–1 shows the pin 211 mounted about a vertical axis in the vise jaw. The clamping member 201 is pivotally mounted on pin 211 for swivel movement within the arcuate recess about the vertical axis 210. Also shown is the arcuate rib 221 in the lower surface of the clamping member 201 and the complementary arcuate groove 222 in the base of the concave recess 204.

Figure 3:
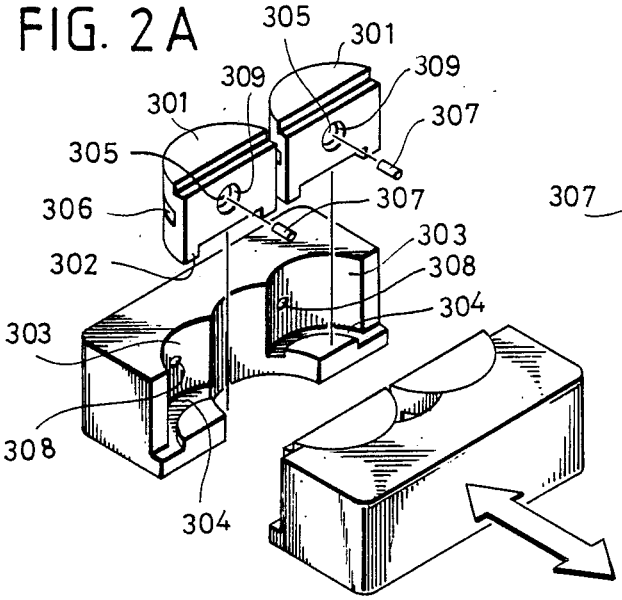
FIG. 3 is an exploded perspective view showing another embodiment of the present invention.
Figures 1, 3:
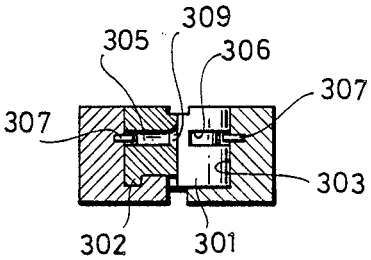

Another embodiment of the clamping member 301 disposed in the concave recess 303 in the jaw is shown in FIG. 3. The bottom side of the rotary/sliding clamping member 301 has a co-axial arcuate rib engaging a groove 304 in the socket base. FIG. 3–1 is an assembly-sectional view. In FIG. 3, the bottom side of every clamping member 301 has a equi-center arcuate rib 302 which engages the groove on the bottom side of the base of the recess 303. The clamping member 301 has a convex surface which is complementary to the concave recess 303 for sliding rotation therebetween. Near the intermediate part of clamping face of the clamping member 301, there is a penetrating hole 305 cooperating with a blind end groove 306 on the rear side of the clamping member 301. A connecting pin 307 is inserted in the penetrating hole 305. A tapping hole 308 is disposed near the intermediate part of the recess 303 such that the tapping hole 308 communicates with the blind end groove 306. The connecting pin 307 is received by the tapping hole 308 and extends to the blind end groove 306. The penetrating hole 305 may have a flared shape 309 (FIG. 3–1) on the clamping side and is useful for installing the penetrating pin 307 and for clamping smaller ball-shaped workpieces. The embodiment has the following features:

The upper surface of the jaw is one piece. The clamping member 301 has a penetrating hole 305 therein which communicates with a blind end groove 306 on the convex surface of the clamping member 301. The concave surface of the recess 303 in the jaw has a tapping hole 308 therein, the tapping hole 308 communicating with the blind end groove 306. A connecting pin 307 is inserted through the penetrating hole 305 and into the tapping hole 308. The pin 307 extends into the blind end groove 306 such that it does not interfere with rotation of the clamping member 301.

This structure has a single pin which is simple to fabricate and provides a secure means of engaging the rotary clamping member to the jaw.

Figure 4:
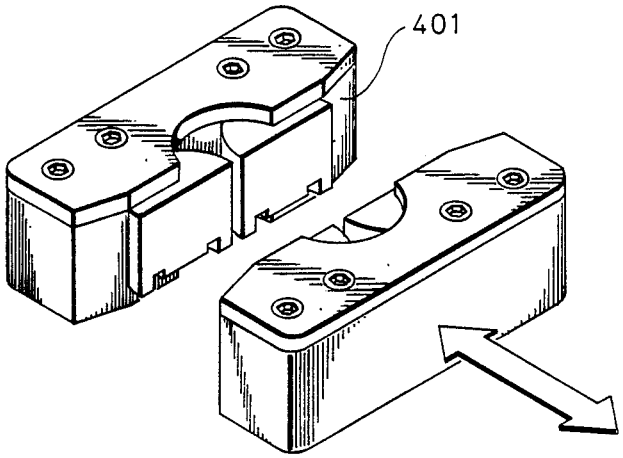
FIG. 4 is a perspective view of still another embodiment of the present invention.

Another embodiment is shown in FIG. 4 in which a single retaining cover is disposed on the upper surface of the jaw. The semi-circular clamping members are complementary to the concave recesses in the jaw as in the previously described embodiments and the base of the clamping members have arcuate ribs which are received in an arcuate groove in the base of the concave recess. The single retaining cover prevents processing chips from falling between the concave recess and the convex surface of the clamping member and also securely hold the clamping members in the jaw.

Obviously, many modifications may be made without departing from the basic spirit of he present invention. Accordingly, it will be appreciated by those skilled in the art that within the scope of the appended claims, the invention may be practiced other than has been specifically described herein.

I claim:

1. A clamping apparatus comprising:

a vise jaw having a top surface, a jaw face, a pair of concave recesses formed laterally of each other in the jaw face, each concave recess further having an arcuate shoulder thereon formed at the top surface of vise jaw, each concave recess having a base having an arcuate groove thereabout;

a clamping member independently disposed in each of the recesses and having a convex surface substantially complementary to the respective concave recess, the concave recesses and the convex surfaces being formed about a vertical axis, wherein in a cross sectional plane substantially at right angles to the respective axis, each axis forms the center of a semicircle substantially defining the respective concave recesses and convex surfaces, the clamping member being substantially semicircular in cross section;

each clamping member having a flat upper surface and a lower surface; each upper surface further having a semicircular boss thereon, the boss having a base and an upper surface such that the boss has a step-like relationship to the clamping member;

a pair of retaining covers each having an upper surface, each cover formed as an arcuate plate, each cover disposed in the arcuate shoulder and extending over the clamping member so as to abut the semicircular boss on the upper surface of each clamping member such that processing chips are prevented from falling between the concave recess in the jaw and the convex surface of the clamping member;

means for securing the retaining cover to the vise jaw; and the lower surface of the clamping member having an arcuate rib thereabout complementary with the arcuate groove in the base of the concave recess such that when the clamping member is placed in the recess in the jaw, the rib engages the groove and the clamping member is seated in the recess in the jaw and is further secured by the retaining cover to hold the clamping member such that the upper surface of the boss, the upper surface of the retaining cover and the top surface of the vice jaw form a continuous surface; and the clamping member may swivel in the arcuate recess in the vise jaw.

2. The clamping apparatus of claim 1, wherein the upper surface of each clamping member is dovetailed downwardly, sloping from the convex surface of the clamping member to the base of the semicircular boss such that the base has a step-like relationship to the clamping member; and each retaining cover further having a lower surface, the lower surface having a protruding sloping lip thereabout such that when the retaining cover is disposed on the arcuate shoulder, the sloping lip is complementary to the sloping surface of the clamping member.

3. In a clamping apparatus, the combination of a vise jaw having an arcuate recess formed therein and further having an arcuate groove formed therein, the arcuate groove depending from the arcuate recess and in communication therewith; a pin mounted about a vertical axis in the vise jaw and projecting upwardly into the arcuate recess, a clamping member pivotably mounted on the pin for swivel movement within the arcuate recess in the vise jaw, the clamping member having a depending arcuate rib slidably received in the arcuate groove in the vise jaw, thereby guiding the clamping member for swivel movement in the recess in the vise jaw, the clamping member further having a top surface formed with an arcuate groove, and a retaining cover carried by the vise jaw, the retaining cover having an arcuate flange received in the arcuate groove in the top surface of the clamping member, thereby retaining the clamping member in the arcuate recess in the vise jaw; wherein the clamping member has a convex surface substantially complementary to the arcuate recess in the vice jaw, the arcuate groove on the top of the clamping member sloping downwardly from the convex surface of the clamping member; the retaining plate having a lower surface, the lower surface having a protruding sloping lip thereabout such that protruding sloping lip is complementary to the groove on the top of the clamping member and the retaining plate is received in the arcuate groove on the top of the clamping member thereby retaining the clamping member in the arcuate recess in the vise.

* * * * *